US012546502B1

(12) United States Patent
Utt

(10) Patent No.: US 12,546,502 B1
(45) Date of Patent: Feb. 10, 2026

(54) AIR HANDLER ASSEMBLY

(71) Applicant: Timothy Utt, Jensen Beach, FL (US)

(72) Inventor: Timothy Utt, Jensen Beach, FL (US)

( * ) Notice: Subject to any disclaimer, the term of this patent is extended or adjusted under 35 U.S.C. 154(b) by 165 days.

(21) Appl. No.: 18/426,545

(22) Filed: Jan. 30, 2024

Related U.S. Application Data

(63) Continuation-in-part of application No. 17/367,202, filed on Jul. 2, 2021, now abandoned.

(51) Int. Cl.

| | |
|---|---|
| ***F24F 13/30*** | (2006.01) |
| ***F24F 1/0284*** | (2019.01) |
| ***F24F 1/03*** | (2019.01) |
| ***F24F 1/0325*** | (2019.01) |
| ***F24F 11/72*** | (2018.01) |
| ***F24F 13/22*** | (2006.01) |

(52) U.S. Cl.
CPC ..... *F24F 11/72* (2018.01); *F24F 1/0284* (2019.02); *F24F 1/0325* (2019.02); *F24F 13/222* (2013.01); *F24F 13/30* (2013.01)

(58) Field of Classification Search
CPC .. F24F 3/00; F24F 13/20; F24F 13/222; F24F 1/0287; F24F 1/032; F24F 1/0323; F24F 1/0325; F24F 3/044
See application file for complete search history.

(56) References Cited

U.S. PATENT DOCUMENTS

2011/0303396 A1* 12/2011 Ishida ..... F24F 1/16 165/121
2024/0255159 A1* 8/2024 Sung ..... F24F 1/04

FOREIGN PATENT DOCUMENTS

WO WO-2013107007 A1 * 7/2013 ..... F24F 6/04
WO WO-2018180279 A1 * 10/2018 ..... F24F 13/222

OTHER PUBLICATIONS

"Facilitate" definition, Merriam-Webster Online Dictionary, retrieved Sep. 1, 2025 from https://www.merriam-webster.com/dictionary/facilitate.*

* cited by examiner

*Primary Examiner* — Jerry-Daryl Fletcher
*Assistant Examiner* — Daniel C Comings
(74) *Attorney, Agent, or Firm* — Gulf Coast Intellectual Property Group

(57) ABSTRACT

An air handler assembly provides an air handler that resides completely on a drain pan, and comprises multiple panels. At least two panels join at the edges to form an enclosed chamber with central region. Two of the opposing panels are apertured to enable passage of air. Multiple coils carrying cooling fluid are disposed in a parallel relationship, and on the inner side, of the coil panels. A blower forces high velocity air through one or more opposing coil panels, and across the coils to cool the air. From the coils, cooled air flows to central region of air handler. A fan at the top of the air handler draws the cooled air from an outlet opening that forms in a top panel for dispersing through a duct or plenum.

4 Claims, 5 Drawing Sheets

AIR HANDLER ASSEMBLY

CROSS REFERENCE TO RELATED APPLICATIONS

This application is a continuation-in-part of U.S. application Ser. No. 17/367,202, filed Jul. 2, 2021 and entitled MINIATURIZED AIR HANDLER ASSEMBLY, in the name of Timothy Utt, which is hereby incorporated for reference.

FIELD OF THE INVENTION

The present invention relates generally to a miniaturized air handler assembly. More so, the present invention relates to an air handler that sits on a drain pan, and intakes air from opposing coil panels, or a panel formed from a plurality of coils arranged in parallel, such that the air flows across the coils that carry a cooling fluid, thereby cooling the air; and further draws in the cooled air with a fan to disperse through an HVAC duct or plenum; whereby the intake of air from opposing panels enables the miniaturization of the air handler.

BACKGROUND

The following background information may present examples of specific aspects of the prior art (e.g., without limitation, approaches, facts, or common wisdom) that while expected to be helpful to further educate the reader as to additional aspects of the prior art, is not to be construed as limiting the present invention, or any embodiments thereof, to anything stated or implied therein or inferred thereupon.

Often, buildings and enclosed structures are cooled using chilled water that is circulated through the building. In many instances, the chiller utilizes water conduits to carry the chilled water through the building. The water conduits are routed to air handlers located on individual floors and sections of the building. The air handlers push or pull air past colling coils through which the chilled water flows. Heat is removed from the air by the cooling coils and the chilled water within the cooling coils. During this cycle, the chilled water warms up and is returned via water conduits to one or more chillers for cooling. The chillers controllably adjust the temperature of the chilled water output for the air handlers.

As variables such as temperature and humidity vary, multiple chillers, pumps, or colling towers may need to be brought online or taken offline to serve the varying cooling needs of the building. It can be problematic to efficiently control a chiller plant for a building. Due in part to the varying nature of the building environment (e.g., occupancy, etc), the varying nature of weather (e.g., temperature, humidity, etc.), and the varying nature of equipment performance.

Typically, the capacity of an air conditioning unit is directly related to the surface area of the cooling coil. The higher the BTU removal capacity of the cooling coil, the larger the cooling coil needs to be which requires a larger cabinet to house the coil as well as a larger space to fit the entire air conditioning unit. Since space is at a premium in most building and mechanical rooms, a substantial amount of room is needed to fit conventional cooling coil design in these air conditioning systems.

Also due to the size of such air conditioning units, it can be difficult to change and maintain. The capacity of the air conditioning unit is directly related to the surface area of the cooling coil. The higher the BTU removal capacity of the colling coil, the larger the cooling coils need to be. This requires larger space to fit the entire air conditioning unit.

With space being at a premium in building and mechanical rooms, a substantial amount of space is required to fit conventional cooling coil design in such air conditioning units. Also due to the size of these air conditioning units, it is often difficult to change and maintain. Further, the higher capacity of an air conditioning unit in BTU's the larger the cooling coil section needs to be and with a single direction airflow unit this requires larger rooms and coil pull areas to service the cooling coil or change if necessary.

Other proposals have involved air conditioning units that have smaller profiles, The problem with these units is that they do not intake air from multiple sides of the unit. Also, they allow excess condensate to fall into components of the air handler, causing flooding. Even though the above cited air conditioning units meet some of the needs of the market, a miniaturized air handler assembly that includes an air handler that sits on a drain pan, and intakes air from opposing coil panels across coils that carry a cooling fluid thereby colling the air; and further draws in the cooled air with a fan to disperse through and HVAC duct or plenum; whereby the intake of air through opposing panels, or a wall of coils, enables the miniaturization of the air handler, is still desired.

SUMMARY OF THE INVENTION

Illustrative embodiments of the disclosure are generally directed to a miniaturized air handler assembly. The miniaturized air handler assembly provides a unique air handler that resides completely on a drain pan. The air handler comprises multiple panels forming an enclosed chamber with a central region. Two of the opposing panels are apertured, or coil assemblies, so as to enable passage of air from outside to the enclosed chamber. Multiple cooling coils, which carry a cooling fluid, are disposed in a generally parallel relationship, and on the inner side, of the coil panels. A blower forces high velocity air through the two opposing coil panels, and across the cooling coils. This serves to cool the air. The condensate that inherently forms on the cooling coils falls into the drain pan; and thereby does not travel into the subsequent components of the air handler.

From the cooling coils, the cooled air flows to the central region of the air handler. A fan at the top of the air handler sucks the cooled air from an outlet opening that forms in a top panel for dispersing through a duct or plenum. The air handler is unique in that, the intake of air from opposing panels enables the miniaturization of the air handler. The air handler is also unique in that the condensate never reaches the fan or central region of the air handler, because the high velocity airflow causes condensate to drip, or fall, off the surface of the cooling coils, and into the drain pan. In essence, all the air and condensate enter into the central region. It is known in the art that in prior art units, such condensate flooded the air handler if the condensate blew off the coil missing the drain pan. This is known in the industry as carry over.

In one aspect, a miniaturized air handler assembly, comprises; Multiple coil panels comprising multiple cooling coils arranged in fluid communications, the coil panels having multiple edges, the cooling coils operable to carry a cooling fluid, the cooling coils forming a fluid inlet operable to enable ingress of the cooling fluid, the cooling coils further forming a fluid outlet operable to enable egress of the cooling fluid;

A cooling fluid manifold having a manifold inlet and a manifold outlet, the manifold inlet and the manifold outlet being in fluid communication with the fluid inlet and the fluid outlet of the cooling coils; At least one screen overlaying the coil panels, the screen defining multiple apertures; multiple solid panels having multiple edges, whereby the edges of the coil panels and the solid panels join to form an enclosed chamber, the enclosed chamber defining a central region; At least one of the solid panels defining an outlet opening, the outlet opening enabling egress of the air from the enclosed chamber.

A fan disposed over the outlet opening, the fan operable to draw air into the enclosed chamber through the coil panels, whereby the cooling coils help cool the incoming air, whereby the air passing through the coil panels accumulates in the central region of the enclosed chamber. The fan also operable to draw the cooled air from the central region through the outlet opening; a drain pan defining a surface having a perimeter flange, the surface of the drain pan supporting the coil panels and the solid panels, whereby the coil panels and the solid panels are substantially disposed inside the perimeter flange of the drain pan and a duct or a plenum, the duct or the plenum being joined with the top panel and in fluid communication with the enclosed chamber through the outlet opening, the duct or the plenum being operable to carry the cooled air drawn in by the fan.

In another aspect, the enclosed chamber defines a cubicle or a rectangular shape. However, the shape can also be any polygon with at least two cooling coils with flow in opposing direction into the center of the chamber.

In another aspect, at least two of the panels are solid. In other embodiments, the chamber can be created by any number of cooling coils. For example, four cooling coils can be joined at the corners to create a chamber, whereby no solid panel would be necessary other than connection pieces on the corner to prevent air infiltration.

In another aspect, the panels are fabricated from metal.

In another aspect, the cooling coils are arranged vertically in relation to the coil panels.

In another aspect, the cooling coils are arranged horizontally in relation to the coil panels.

In another aspect, the cooling coils are evaporator cooling coils.

In another aspect, the cooling coils include six rows or coils that about total of one hundred-eighty tubes and two hundred-forty vertical fins.

In another aspect, the assembly further comprises one or more blowers operable to blow the air at a high velocity across the cooling coils and into the enclosed chamber, whereby the air is cooled, whereby the air accumulates in the central region of the enclosed chamber.

In another aspect, the blowers are operable to blow the air at a high velocity through at least two of the coil panels, and across the cooling coils into the enclosed chamber.

In another aspect, the blowers are operable to blow the air at a high velocity of about 1,000 feet per minute through at least two of the coil panels, and across the cooling coils into the enclosed chamber. However, it is significant to note that the CFM does not have to be specific other than the industry standard can be exceeded due to the minimized impact of carry over.

In other aspect, the assembly further comprises a duct or a plenum, the duct or the plenum being joined with the top panel and in fluid communication with the enclosed chamber through the outlet opening, the duct operable to carry the cooled air sucked by the fan.

In another aspect, the assembly further comprises a bracket that is configured to fasten the fan to the panel that forms the outlet opening.

In another aspect, the drain pan forms a drain hole.

In another aspect, the cooling coils form a fluid inlet operable to enable ingress of the cooling fluid.

In another aspect, the cooling fluid comprises chilled water.

In another aspect, the fan comprises a processor operable to regulate power and speed of the fan.

One objective of the present invention is to provide a miniaturized air handler.

Another objective is to enable increased air flow across cooling coils (such as 1,000/ft/minute rather than industry standard of 100/ft/minute) without having condensate clog up the air handler components. The air handler assembly allows for velocities in excess of the industry standards due to any carry over that may occur will be limited to the drain.

Yet another objective is to prevent condensate from dripping into air handler and clogging therein.

Another objective is to retrofit the air dandler assembly into an HVAC, or manufacture the air handler with an HVAC system.

Another objective is to increase the BTU's over prior art HVAC systems.

An exemplary objective is to provide a 40-ton capacity air handler. However, it is significant to note that the capacity of the air handler is not necessarily defined, as the capacity is determined by the actual selection of the cooling coils and how many cooling coils are used. Also, the capacity is determined by the CFM of the fan, evaporator coil size and capacity, temperature and flow the cooling medium such as chilled water.

Additional objectives are to provide an inexpensive way to manufacture HVAC system.

Other systems, devices, methods, features and advantages will be or become apparent to one with skill in the art upon examination of the following drawings and detailed description. It is intended that all such additional systems, methods, features and advantages be included with this description, be within the scope of the present disclosure and be protected by the accompanying claims and drawings.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
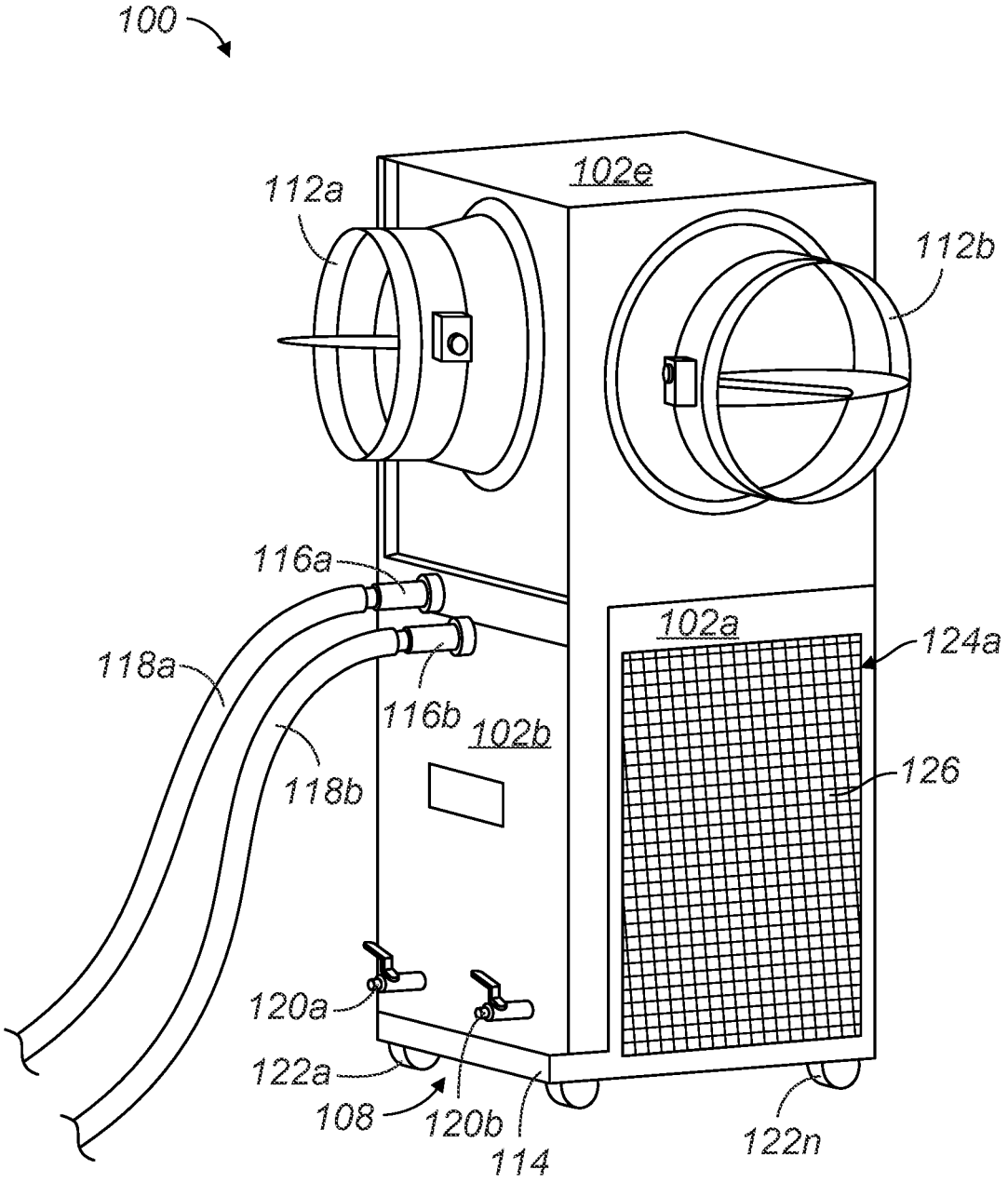
FIG. 1 illustrates a perspective view of an exemplary miniaturized air handler assembly, in accordance with an embodiment of the present invention.
Figure 2:
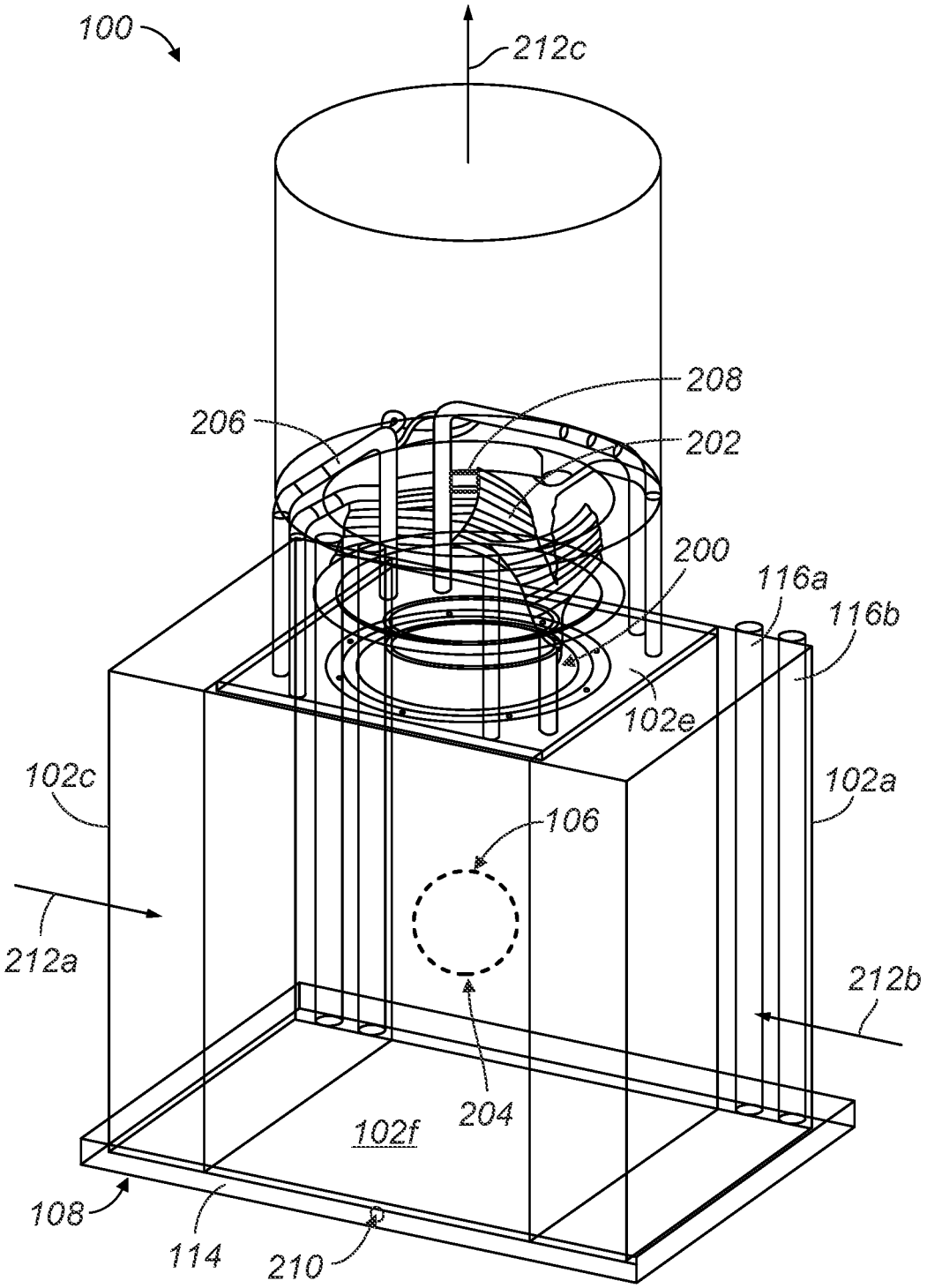
FIG. 2 illustrates a sectioned perspective view of the miniaturized air handler assembly showing the enclosed chamber, in accordance with an embodiment of the present invention.
Figure 3:
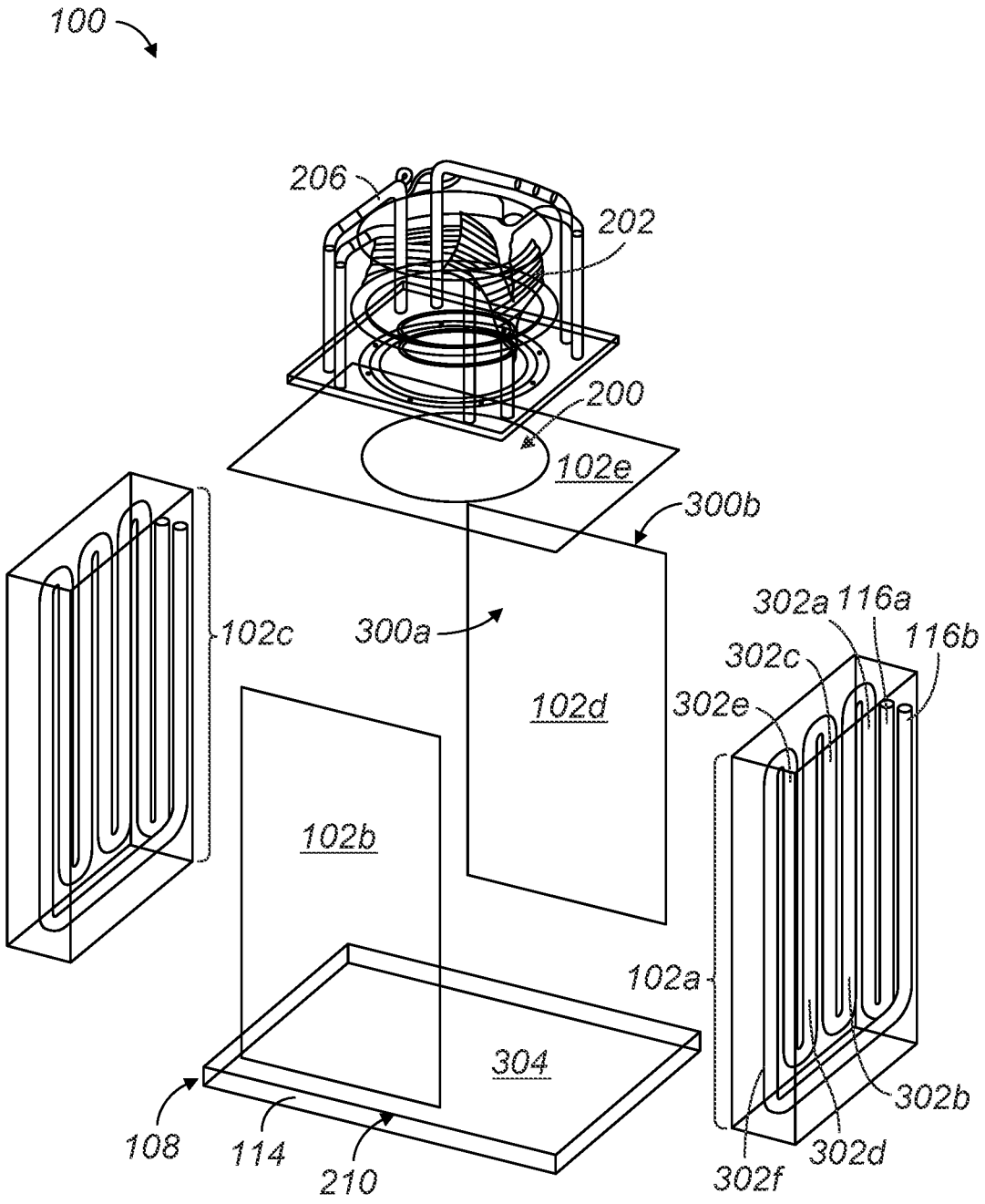
FIG. 3 illustrates a exploded diagrammatic view of the miniaturized air handler assembly in accordance with an embodiment of the present invention.

Referring now to the drawings submitted herewith, wherein various elements depicted therein are not necessarily drawn to scale and wherein through the views and figures like elements are referenced with identical reference numerals, there is illustrated a miniaturized air handler assembly 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, a miniaturized air handler assembly 100 is referenced in FIGS. 1-5. The miniaturized air handler assembly 100, hereafter "assembly 100" provides a miniaturized version of an air handler unit, that not only takes up lesser space than prior art air handlers, but also turns out greater BTU's than the prior art air handlers and HVAC systems to optimal positions of the cooling coils, i.e., evaporator cooling coils. The assembly 100 is capable of being scaled down in size due to the use of opposing coil panels 102*a*, 102*c* made up of multiple cooling coils 302*a-f*. Two sets of cooling coils 302*a-f* may form a wall, of sorts, on opposing sides of the air handler. This dual cooling concept exponentially increases the cooling effect of the air handler, while also allowing for a smaller dimension.

Additionally, the assembly 100 rests within a perimeter flange of a drain pan 108, such as condensate falling from the cooling coils 302*a-f* is restricted from flooding components of the air handler. Such a structural configuration, enables a greater velocity of inbound air to flow over the cooling coils 302*a-f*, thereby increasing BTU's and overall efficiency of the assembly 100. In another novel structural design, the assembly 100 is operable with an HVAC system; either as part of a new A/C unit or retrofitted to an existing A/C unit.

In one exemplary use, the assembly 100 has a unique configuration of coil panels 102*a*, 102*c* that cools incoming air. The coil panels 102*a*, 102*c* comprise multiple cooling coils 302*a-f*, i.e., evaporator cooling coils. The cooling coils 302*a-f* are sized and dimensioned to carry a cooling fluid, such as chilled water, that cools incoming air. The coil panels and multiple solid panels 102*b*, 102*d*, 102*e*, 102*f* may join at the edges to form an enclosed chamber 204 where cooled air accumulates before being sucked in to a duct.

In any case, the cooling coils 302*a-f* are arranged in a continuous, side-by-side relationship with each other while carrying a cooling fluid. When the edges coil panel are joined with the other coil panels, or solid panels, the square or rectangular-shaped enclosed chamber 204 is formed. Air is sucked through the coil panels to accumulate into the enclosed chamber, where a fan sucks the cooled air through exterior ducts. Additionally, the coil panel rests atop a drain pan 108, such that all the cooling coils 302*a-f* are within the perimeter of the drain pan 108, and any falling condensate from blowing air falls into the drain pan 108.

In one possible embodiment, the cooling coils are normally referred t as "Cooling Coils." In the case of Chilled Water, they are referred to as "Chilled Water Coils" in the case of DX (Direct Expansion) they are referred to as Cooling coils. An in the case of heating, they can just be referred to as heating coils, or heating elements if electricity is used to heat.

The assembly 100 comprises multiple solid panels 102*b*, 102*d*, 102*e*, 102*f* that form the structural framework for the air handler. As discussed below, the solid panels, and adjoining coil panels form an arrangement that creates an enclosed chamber 204 where cooled air accumulates. For example, the edges pf the solid panels are configured to join with the edges of the coil panels to form the enclosed chamber 204. In some embodiments, the edges of the coiled and solid panels can join through welding, or through use of fasteners, such as bolts. In other embodiments, the solid panels are solid, having no openings, outlets, or apertures. In yet other embodiments, the solid panels are fabricated from aluminum, metal, or metal alloys.

In one possible embodiment, the solid panels include two side panels 102*b*, 102*d*, a top solid panel 102*d*, and a bottom solid panel 102*f* join to form cubicle or rectangle shape of the enclosed chamber. In alternative embodiments multiple corner reinforcement panels (not shown) may also be used to help seal the enclosed chamber. In any case, the enclosed chamber 204 is generally sealed and weatherproofed. Formed from the panels, the enclosed chamber 204 defines a central region 106, which is generally concentric from the inner surfaces of the panels 102*a-f*. The central region 106 is significant in that cooled air accumulates there before being sucked out into a duct 112*a*, 112*b* or plenum. In one embodiment, multiple wheels 122*a*, 122*n* at the drain pan or bottom panel enable mobility of assembly 100. Four wheels may be used in one embodiment.

Looking now at the Figures submitted as a part hereof, at least two of the solid panels 102*b*, 102*d* are defined by an inner side 300*a*, an outer side 300*b*. The inner side 300*a* faces the enclosed chamber 204, while the outer side 300*b* orients out so as to be visible. The Figures submitted as a part hereof illustrates the air handler with top solid panel 102*e* removed, and showing the cooling coils 302*a-f* vertically oriented. The Figures submitted as a part hereof illustrates the air handler with the top solid panel 102*e* reattached to cover the cooling coils 302*a-f*.

The top solid panel 102*e* defines an outlet opening 200 (FIG. 3A). The outlet opening 200 enabling egress of air 212*c* from the enclosed chamber 204. In one embodiment, a duct 112*a*, 112*b* or plenum is in fluid communications with the enclosed chamber 204 through the outlet opening 200. It is known in the art that the duct 112*a*, 112*b* and the plenum are configured to carry cooled air that is drawn in by the fan 202 for subsequent dispersion through an HVAC system. However, in other embodiments, other cool air outlet mechanisms known in the art may also be in fluid communication with the central region 106, through the outlet opening 200 in the top panel 102*e*.

In alternative embodiments, some of the solid panels may include blank off panels. Depending on capacity and arrangement of the coiling tubes, the blank off panels serve to enclose the enclosed chamber, i.e., coil panel, when all sides are not needed to be an evaporator. The blank off panels can also be used to service the inside portion of cooling 302*a-f* and the drain pan 108. The top panel 102*e* encloses the enclosed chamber but has an outlet opening 200 to allow the air to flow into the fan 202.

Uniquely, the entire assemblage of panels, and cooling coils 302*a-f*, discussed below, reside on a drain pan 108. The drain pan 108 comprises a surface 304 having a perimeter flange 114. The surface 304 may be slightly sloped to enable condensate drippings to flow out of the drain hole 210 in the side of the drain pan 108. The drain hole 210 may also form at the bottom, or piped to the side of drain pan 108. The surface 304 of the drain pan 108 supporting the panels 102*a-f*. The panels 102*a-f* are substantially disposed inside the perimeter flange 114 of the drain pan 108, such that any condensate that drips from the cooling coils falls onto the surface 304 of the drain pan 108, rather than into the components of the assembly 100.

As shown in the Figures submitted as a part hereof, the coil panels 102*a*, 102*c* can be a flat shaped panel having a rectangular or square dimension, and possibly forming holes, slots, or other apertures. In other embodiments, the coil panels 102*a*, 102*c* consists of, or has part of its makeup, multiple cooling coils 302*a-f* that are configured to carry a cooling fluid, such as chilled water. However, in other embodiments, the cooling coils could be operable as a DX (direct expansion) system that uses refrigerants gases such as refrigerant.

In one non-limiting embodiment, the cooling coils 302*a-f* are evaporator cooling coils. In one embodiment, the coil panels 102*a*, 102*c* are disposed at opposite ends, such that incoming air flows over the cooling coils 302*a-f* from multiple directions. This enhances the cooling effect, allowing for miniaturized version of air handler. The cooling coils may have a tubular configuration. Any number of cooling coils may also be used on corresponding coil panels 102*a*, 102*c*. And any number of coil panels may be used; including two, three or four that form a cube of coil panels. As the number of coil panels are increased, the BTU's are exponentially increased.

The cooling coils 302*a-f* form a fluid inlet that is sized and dimension to enable ingress of the cooling fluid from manifold inlet 116*a* that provides the cooling fluid. In another embodiment, the cooling coils 302*a-f* have tubular structure, which may include a circular cross section, or other shapes. As is known in the art, the cooling fluid may pass through a chiller-style system prior to flowing into the assembly 100. The cooling coils 302*a-f* can be arranged vertically or horizontally in relation to the inner side of pair of opposing, coil panels. The cooling coils 302*a-f* can be straight or curved. Any number of cooling coils can be utilized, and with fins.

The cooling coils 302*a-f* are arranged in a back-and-forth continuous configuration for carrying the cooling fluid. In any case, the cooling coils 302*a-f* are in fluid communication, and have a fluid inlet to receive fluid, and a fluid outlet to discharge fluid. Additionally, at least one screen 124*a* may be used to overlay the coil panels 102*a*, 102*c*. The screen 124*a-b* may be an aluminum sheet having apertures or slots to enable ingress of air through the coil panels 102*a*, 102*c*.

Significantly, the apertures in the screen enable ingress of air 212*a*, 212*b* through cooling coils 302*a-f*, at opposing sides of the enclosed chamber 204. In one possible embodiment, the apertures are multiple small openings that form a screen. In yet another embodiment, the apertures can be multiple spaced-apart small holes that form across substantially the entire apertured panel. In any case, the capacity to ingress air for passing over the cooling coils 302*a-f* is enabled. In alternative embodiments, a filter 126 may be integrated into the screen 124*a-b*.

In some embodiments, the assembly 100 includes a cooling fluid manifold (not particularly illustrated herein) that is configured to regulate cooling coils 302*a-f*. In one non-limiting embodiment, the cooling fluid manifold has have a manifold inlet 116*a* and a manifold outlet 116*b* that are in fluid communication with the fluid inlet and the fluid outlet of the cooling coils 302*a-f*. An inlet fluid tube 118*a* and an outlet fluid tube 118*b* can feed the manifold inlet 116*a* and manifold outlet 116*b*, respectively. Furthermore, various valves, pressure regulators, and displays known in the art of air handlers may also be used for operation of the cooling fluid manifold. The cooling fluid manifold also has multiple circuits to carry fluid to the cooling coils.

In some embodiments, at least one outlet valve 120*a*, 120*b* can help release excess fluid inside the enclosed chamber or drain pan. In alternative embodiments, a manifold of pipes, valves, and other plumbing fixtures may also be used to carry fluid into and out of the cooling coils 302*a-f*. It is significant to note that different styles of manifolds may be used to feed the cooling coils 302*a-f*.

Looking again at the Figures submitted as a part hereof, the cooling coils 302*a-f* form the entire coil panel, the incoming airflow passes through gaps between the cooling coils 302*a-f*, or in spaces above, below, and to the sides of the cooling coils 302*a-f*, so as to reach the enclosed chamber 204. However, in other embodiments, the cooling coils 302*a-f* are disposed along the inner side of the coil panels 102*a*, 102*c*.

In one embodiment, the cooling coils 302*a-f* and the coil panels 102*a*, 102*c* are arranged in a parallel relationship. This may include six vertical cooling coils 302*a-f* affixed to the inner surface of the coil panels. By affixing to the inner side 300*a* of the coil panels, the high velocity air flows over the cooling coils 302*a-f* before entering the enclosed chamber 204. In this manner, air passing through the coil panels accumulate in the central region 106 of the enclosed chamber 204.

In some embodiments, the cooling coils 302*a-f* are arranged vertically in relation to the coil panels, extending between the top and bottom panels 102*e*, 102*f*. Thus, the cooling coils 302*a-f* extend between the top solid panel 102*e* and the outlet opening 200, and the solid bottom panel 102*f*. In another embodiment, the cooling coils 302*a-f* are arranged horizontally in relation to the coil panels. The horizontal disposition of cooling coils 302*a-f* traverses the coil panels. In the horizontal configuration there would not be cooling coils 302*a-f* on the bottom or top panels. In yet another embodiment, the cooling coils 302*a-f* may extend at a diagonal across the coil panels. In any case, the air passing through cooling coils 302*a-f* accumulates in the central region 106 of enclosed chamber 204. The illustrations show a cooling coil. However, a typical coil would have multiples of rows of coils attached to fins for increasing the surface area of the heat absorption surface.

This design of cooling coils 302*a-f* is to create enclosed chamber 204 that is enclosed using any number of cooling coils 302*a-f* that are straight or curved. The enclosed chamber is formed using a combination of: solid panels, coil panels, the cooling coils 302*a-f*, drain pan 108, and blank off plates. This forms an enclosed chamber 204 into which the air is drawn into from opposing directions outside the panels 102*a-f*. This creates an evaporator environment, formed from a combination of panels and cooling coils 302*a-f* where the air flowing through the cooling coils 302*a-f* are combined into one air stream into the central region, and subsequently discharged from the enclosed chamber 204 through the fan 202.

Looking again at the Figures submitted as a part hereof, the assembly 100 provides a fan 202 to draw in, or forcibly drive, the cooled air in the central region 106 through the outlet opening 200, and into the duct 112*a*, 112*b* or plenum. The fan 202 may be disposed over the outlet opening 200, so as to draw the cooled air from the central region 106 through the outlet opening 200. In one embodiment, the fan 202 comprises a processor 208 operable to regulate power and speed of the fan 202; and thereby the amount of cooled air drawn from the central region 106 of the enclosed chamber 204. A top panel 102*e* and a holding bracket 206 serve to seal the chamber 204 as well has hold the fan 202 in a desired orientation. The size of the outlet opening 200 in the top panel 102*e* is chosen to allow airflow from the central region 106 of the enclosed chamber, and into the fan 202.

In one embodiment, the fan is operable to blow the air at a high velocity through the at least two of the coil panels 102*a*, 102*c*, and across the cooling coils 302*a-f* into the enclosed chamber 204. The fan enables the air to cool and to accumulate in the central region 106 of the enclosed chamber 204. For example, illustrated is two sets of coil panels with opposing airflows blow past the cooling coils 302*a-f* towards each other into the center of the enclosed chamber 204. This high velocity airflow causes condensate to drip, or fall, off the surface of the cooling coils 302*a-f*, which in prior art units, flooded the air handler.

Since, the assembly 100 rests within the perimeter flange 114 of the drain pan 108, the condensate falls directly into the drain pan 108 before reaching the components of the assembly 100. This serves to minimize flooding and damage to the air handler. In this manner, more BTU's can be generated by the assembly 100. It is significant to note that because the cooling coils 302*a-f* and panels 102*a-f* are disposed within the perimeter flange 114 of the drain pan 108, the velocity can reach 1,000 ft/min. Thus, the condensate that inherently forms on the cooling coils 302*a-f* falls into the drain pan 108; and thereby does not travel into the subsequent components of the air handler. In one possible embodiment, a bracket 206 is configured to fasten the fan 202 to the top panel 102*e*, or the panel that forms the outlet opening 200.

The assembly 100 is unique in that the intake of air from opposing coil panels enable the miniaturization of the air handler. The assembly 100 is also unique in that the condensate never reaches the fan 202 or central region 106 of the air handler, because the high velocity airflow causes condensate to drip, or fall, off the surface of the cooling coils 302*a-f*, and into the drain pan 108. It is known in the art that in prior art units, such condensate flooded the air handler.

The assembly 100 reduces the space needed for an air conditioning unit in comparison to an air conditioner unit of similar capacity. In this manner, the assembly 100 creates a more compact air conditioning unit that takes up less space, and is easier to install and replace. Rather than air flow through a single panel of cooling coils 302*a-f*, i.e., evaporator cooling coils in one direction, the assembly 100 uses multiple panels with cooling coils 302*a-f*, where the air flows from opposing coil panels from opposing directions.

As an example of how the design of the assembly 100 (miniaturized Air Handler Unit) increases capacity and can decrease the size. A standard 6 row chilled water coil has a measurement of 24" wide and 40" height with a total capacity of 84,000 BTU's with a standard face velocity of around 500 ft/min.

With this novel invention the BTU capacity can be doubled by using two apposed flow coils (coil panels), tripled by adding three apposed flow coils, and quadrupled by having four apposed flow coils without increasing the size of the unit. So, within an assembly 100 that is just 34"×34" the total capacity can be increased from 84,000 BTU's to 336,000 BTU's. This is an incredible increase in capacity within a very small space.

Beyond the ability to maximize the space by the design of this Novel AHU, the assembly 100 can exceed the industry standard face velocity of the coil, which further increases the BTU capacity of the unit without increasing the size of the unit. This is possible because the negative consequence that comes from exceeding the standard face velocity of about 500 ft/min which causes moisture carryover is mitigated.

As a further example, the coils that are in the assembly 100 shown in the illustration have a BTU capacity of 241,000 BTU's at a face velocity of 700 ft/min. Thus, with two opposed coils, the capacity would be 482,000 BTU's; and with three apposed coils the capacity is 723,000 BTU's; and four coils creates a cube having a capacity of 964,000 BTU's in a space approximately 3'×3' and 45" tall. This creates 80 tons of coiling capacity within a very small space. This is an example of how the design is Novel and truly minimizes the size of an Air Handling Unit.

As a further example, the coils that are in the assembly 100 shown in the illustration have a BTU capacity of 241,000 BTU's at a face velocity of 700 ft/min. Thus, with two opposed coils, the capacity would be 482,000 BTU's; and with three apposed coils the capacity is 723,000 BTU's; and four coils creates a cube having a capacity of 964,000 BTU's in a space approximately 3'×3' and 45" tall. This creates 80 tons of coiling capacity within a very small space. This is an example of how the design is Novel and truly minimizes the size of an Air Handling Unit.

In operation, the fan 202 draws the air into the enclosed chamber 204 and through the cooling coils 302*a-f* into the enclosed chamber 204 created by the closed in cooling coils 302*a-f*. The air is cooled as it passes through the cooling coils into the central region 106. The fan 202 removes the combined air of the cooling coils 302*a-f* from the chamber 204 discharging it from the fan 202 into the duct 112*a*, 112*b* or plenum to condition the area it is to serve.

Advantageously, the assembly 100 can be used in multiple applications. In a first embodiment, the assembly 100 can be installed as part of a new AC unit where the needed space for an air handler is decreased. In a second embodiment, the assembly 100 can be part of an older air handler retrofit to replace old cooling coils and fans. In this instance it can simplify the installation of a new coil and fan 202 unit as it can fit through smaller openings and passageways. In a third embodiment, the assembly 100 can also be used as a standalone temporary air conditioning unit that takes up less space than a conventional temporary air conditioning unit. Additionally, the assembly 100 can be used in Heating, Ventilation or Air conditioning. In another embodiment, a hot fluid is utilized in the cooling coils to heat, rather than to cool. In this heating configuration, the coil panel works in substantially the same manner as described above for cooling.

Figure 4:
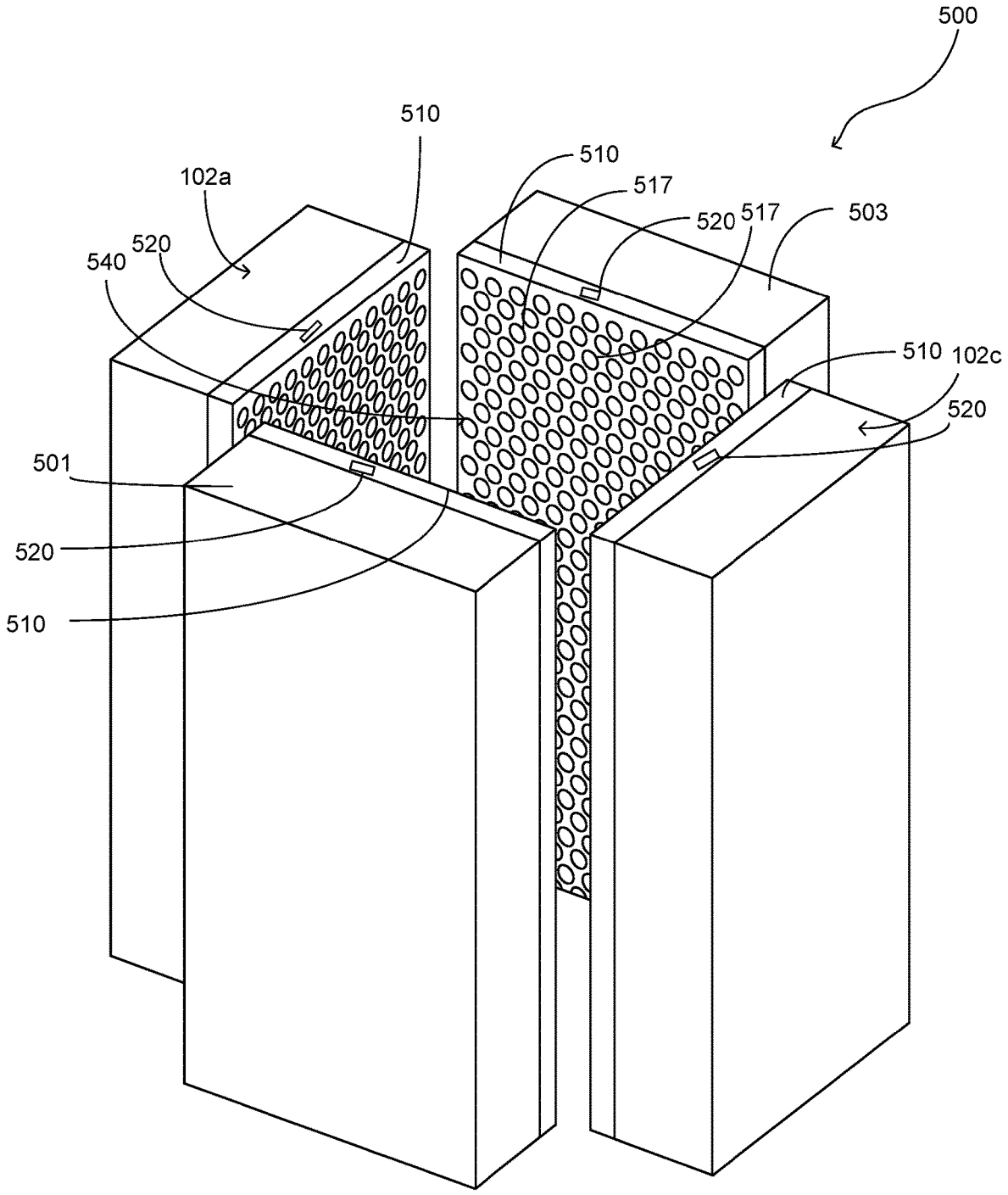
FIG. 4 illustrates an exemplary coil assembly of an embodiment of the present invention.
Figure 5:
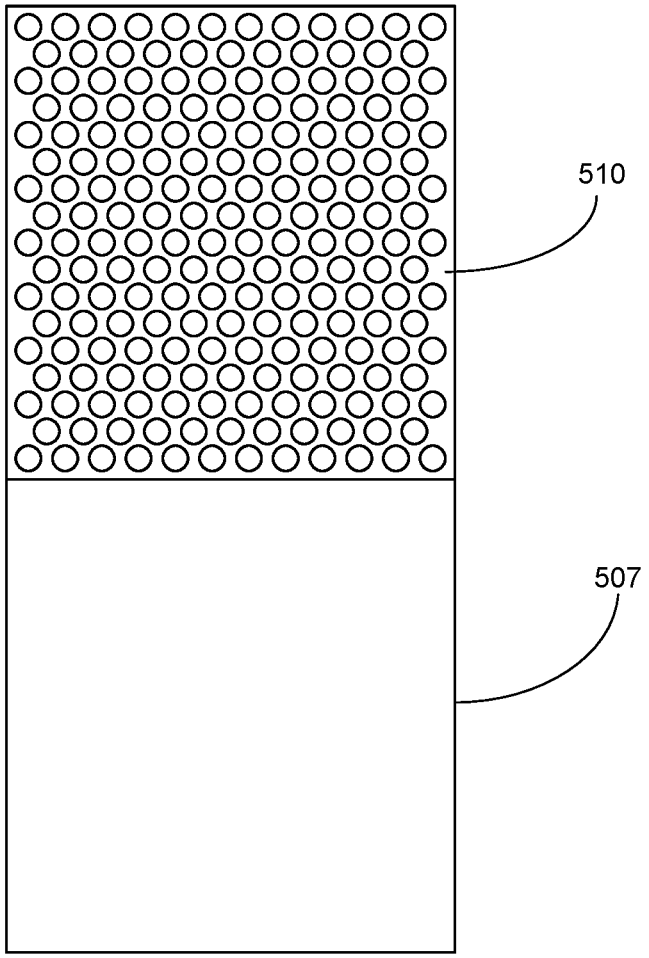
FIG. 5 illustrates an exemplary coil panel of the present invention.

Referring in particular to FIGS. 4 and 5, an exemplary arrangement of a coil assembly 500 is illustrated therein. Opposing coil panels 102*a*, 102*c* are operably positioned with additional opposing coil panels 501, 503. Coil panels 102*a*, 102*c*, 501 and 503 have integrally formed therewith an isolation chamber 510. The isolation chamber 510 includes sidewalls 511 and front wall 515 that are integrally formed to create a void adjacent to the each of the coil panels 102*a*, 102*c*, 501 and 503. The front wall 515 includes a multitude of apertures 517 which permit air to flow therethrough. The isolation chamber 510 is secured to the coil panels 102*a*, 102*c*, 501 and 503 utilizing suitable durable techniques. In a preferred embodiment the isolation chamber 510 is identical in size and shape as the coil panels 102*a*, 102*c*, 501 and 503. It is contemplated within the scope of the present invention that the isolation chamber 510 could be sized so as to only cover a portion of the coil panel 507 as is illustrated herein in FIG. 5.

The isolation chamber 510 adjacent each of the coil panels 102*a*, 102*c*, 501 and 503 allows for accurate temperature and flow control of both the air and hydronic side of the coil panels 102*a*, 102*c*, 501 and 503. Sensors 520 are present within the isolation chamber 510 wherein the sensors 520 are configured to provide monitoring of both air temperature and air flow rate. The sensors 520 allow for individual airflow streams flowing through each of the coil panels 102*a*, 102*c*, 501 and 503 to be controlled in a first mode, individually, or in a second mode, collectively. It is contemplated within the scope of the present invention that the coil assembly 500 could be operably coupled in a modular arrangement wherein multiple coil assemblies could be operably coupled. Furthermore, while the coil assembly 500 employs four coil panels, it is contemplated within the scope of the present invention that the coil assembly 500 could employ more or less than four coil panels. It should be understood that the coil assembly 500 is an alternative embodiment to the two coil panels 102*a*,102*c* arranged with the two solid panels 102*b*,102*d*. The top solid panel 102*e* would be operably coupled to the coil assembly 500 as previously discussed herein having the outlet opening 200 egress of air the enclosed chamber 540.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An air handler assembly, the air handler assembly comprising:

at least two coil panels comprising multiple cooling coils wherein the multiple cooling coils are arranged in fluid communication, the at least two coil panels having multiple edges, the multiple cooling coils operable to carry a cooling fluid, the multiple cooling coils forming a fluid inlet operable to enable ingress of the cooling fluid, the multiple cooling coils further forming a fluid outlet operable to enable egress of the cooling fluid, the at least two coil panels having a first side and a second side, wherein the at least two coil panels are configured to permit air to flow therethrough entering on said first side and exiting on said second side, wherein the at least two coil panels further include an isolation chamber, said isolation chamber being adjacent said second side of said at least two coil panels and operably coupled to the second side of the at least two coil panels, said isolation chamber having sidewalls and a front wall integrally formed to create a void, said front wall of said isolation chamber having a multitude of apertures allowing air to flow therethrough;

a cooling fluid manifold having a manifold inlet and a manifold outlet, the manifold inlet and the manifold outlet being in fluid communication with the fluid inlet and the fluid outlet of the cooling coils;

at least one screen overlaying the coil panels, the screen defining multiple apertures;

at least two solid panels having multiple edges, whereby the edges of the at least two coil panels and the at least two solid panels join to form an enclosed chamber, the enclosed chamber defining a central region, wherein the at least two coil panels are located on opposing sides of the enclosed chamber and wherein the at least two solid panels are located on opposing sides of the enclosed chamber;

at least one of the at least two solid panels having an outlet opening, the outlet opening enabling egress of the air from the enclosed chamber;

a fan disposed over the outlet opening, the fan operable to draw air into the enclosed chamber through the at least two coil panels located on opposing sides of the central region wherein the air enters the enclosed chamber from a first side of the enclosed chamber through one of the at least two coil panels and the air enters the enclosed chamber from a second side through one of the at least two coil panels, whereby the at least two coil panels lower a temperature of the air, whereby the air passing through the at least two coil panels on opposing sides of the enclosed chamber accumulates in the central region of the enclosed chamber, the fan also operable to draw the air from the central region through the outlet opening;

a drain pan defining a surface having a perimeter flange, the surface of the drain pan supporting the at least two coil panels and the at least two solid panels, whereby the at least two coil panels and the at least two solid panels are substantially disposed inside the perimeter flange of the drain pan; and a duct or a plenum, the duct or the plenum being joined with a top panel superposed the enclosed chamber and in fluid communication with the enclosed chamber through the outlet opening, the duct or the plenum being operable to carry the cooled air drawn in by the fan.

2. The air handler assembly as recited in claim 1, wherein said isolation chamber covers only a portion of the second side of the at least two coil panels.

3. The air handler assembly as recited in claim 2, and further including a sensor, said sensor being mounted in said isolation chamber of said at least two coil panels, said sensor configured to monitor airflow and temperature.

4. An air handler assembly, the air handler assembly comprising:

a coil assembly, said coil assembly having four coil panels, said four coil panels being rectangular in shape and comprising multiple cooling coils wherein the multiple cooling coils are arranged in fluid communication, said four coil panels operably coupled to create an enclosed chamber defining a central region, the four coil panels having multiple edges, the multiple cooling coils operable to carry a cooling fluid, the multiple cooling coils forming a fluid inlet operable to enable ingress of the cooling fluid, the multiple cooling coils further forming a fluid outlet operable to enable egress of the cooling fluid, the four coil panels having a first side and a second side, wherein the four coil panels are configured to permit air to flow therethrough entering on said first side and exiting on said second side so as to flow into said chamber, wherein the four coil panels further include an isolation chamber, said isolation chamber being adjacent said second side of said four coil panels and operably coupled to the second side of the four coil panels, said isolation chamber having sidewalls and a front wall integrally formed to create a void, said front wall of said isolation chamber having a multitude of apertures allowing air to flow therethrough;

a sensor, said sensor being mounted in said isolation chamber of said four coil panels, said sensor configured to monitor airflow and temperature, said sensor facilitating an ability to operate the air handler assembly in a first mode and a second mode;

a cooling fluid manifold having a manifold inlet and a manifold outlet, the manifold inlet and the manifold outlet being in fluid communication with the fluid inlet and the fluid outlet of the cooling coils;

at least one screen overlaying the first side of the four coil panels, the at least one screen having multiple apertures;

at least one of the four coil panels having an outlet opening, the outlet opening enabling egress of the air from the enclosed chamber;

a fan disposed on a top panel, said top panel superposed the enclosed chamber, the fan operable to draw air into the enclosed chamber through the four coil panels located on opposing sides of the central region wherein the air enters the enclosed chamber through one of the four coil panels, whereby the coil assembly lowers a temperature of the air, whereby the air passing through the four coil panels accumulates in the central region of the enclosed chamber, the fan also operable to draw the air from the central region through the outlet opening;

a drain pan defining a surface having a perimeter flange, the surface of the drain pan supporting the four coil panels, whereby the four coil panels are substantially disposed inside the perimeter flange of the drain pan; and a duct or a plenum, the duct or the plenum being joined with the top panel and in fluid communication with the enclosed chamber through the outlet opening, the duct or the plenum being operable to carry the cooled air drawn in by the fan.

* * * * *